US009039379B2

(12) United States Patent
Radomski

(10) Patent No.: US 9,039,379 B2
(45) Date of Patent: May 26, 2015

(54) RETENTION DEVICE FOR A COMPOSITE BLADE OF A GAS TURBINE ENGINE

(75) Inventor: Steven A. Radomski, Nottingham (GB)

(73) Assignee: ROLLS-ROYCE plc, London (GB)

( * ) Notice: Subject to any disclaimer, the term of this patent is extended or adjusted under 35 U.S.C. 154(b) by 548 days.

(21) Appl. No.: 13/427,068

(22) Filed: Mar. 22, 2012

(65) Prior Publication Data

US 2012/0257981 A1 Oct. 11, 2012

(30) Foreign Application Priority Data

Apr. 11, 2011 (GB) ..... 1106050.6

(51) Int. Cl.
*F01D 5/30* (2006.01)
*F01D 5/28* (2006.01)
*F01D 5/32* (2006.01)

(52) U.S. Cl.
CPC ..... *F01D 5/3092* (2013.01); *F01D 5/3007* (2013.01); *F01D 5/282* (2013.01); *F01D 5/323* (2013.01); *F05D 2300/603* (2013.01)

(58) Field of Classification Search
CPC ..... F01D 5/30; F01D 5/3007; F01D 5/3092; F01D 5/323; F01D 5/282; F05D 2300/603
USPC ..... 416/204 R, 204 A, 219 R, 220 R, 220 A, 416/219 A, 223 R, 248, 500, 224
See application file for complete search history.

(56) References Cited

U.S. PATENT DOCUMENTS 2,317,338 A * 4/1943 Rydmark ..... 416/221
2,786,648 A 3/1957 Ledwith
2,874,932 A * 2/1959 Sorensen ..... 416/220 R
2,928,651 A * 3/1960 Turnbull ..... 416/221
3,202,398 A * 8/1965 Webb ..... 416/220 R
3,383,094 A * 5/1968 Diggs ..... 416/221
3,383,095 A * 5/1968 Anderson ..... 416/220 R
3,598,503 A * 8/1971 Muller ..... 416/221
3,653,781 A * 4/1972 Cooper ..... 416/221
3,720,480 A * 3/1973 Plowman et al. ..... 416/220 R
3,910,719 A * 10/1975 Hessler et al. ..... 416/134 R
4,102,602 A * 7/1978 Rottenkolber ..... 416/221
4,169,694 A * 10/1979 Sanday ..... 416/219 R (Continued)

FOREIGN PATENT DOCUMENTS

EP 0 495 586 A1 7/1992
EP 2 042 689 A1 4/2009

(Continued)

OTHER PUBLICATIONS

Jun. 14, 2012 European Search Report issued in Application No. EP 12 16 0708.

(Continued)

*Primary Examiner* — Nathaniel Wiehe
*Assistant Examiner* — Wayne A Lambert
(74) *Attorney, Agent, or Firm* — Oliff PLC

(57) ABSTRACT

A liner for a composite blade of a gas turbine engine includes a metallic shoe, operable substantially to encase a blade root of a composite blade and defining an inner surface and an outer surface. The liner also includes a retention lug formed on the shoe and has inner and outer keys that project from opposed portions of the inner and outer surfaces. The keys engage corresponding recesses on a dovetail slot and a blade root to resist axial displacement of the composite blade.

13 Claims, 3 Drawing Sheets

(56) References Cited

U.S. PATENT DOCUMENTS

| | | | | | |
|---|---|---|---|---|---|
| 4,207,029 | A | | 6/1980 | Ivanko | |
| 4,417,854 | A | * | 11/1983 | Cain et al. | 416/241 B |
| 4,462,756 | A | * | 7/1984 | Muggleworth et al. | 416/215 |
| 4,527,952 | A | * | 7/1985 | Forestier et al. | 416/220 R |
| 4,655,687 | A | * | 4/1987 | Atkinson | 416/193 A |
| 4,818,182 | A | * | 4/1989 | Bouru | 416/215 |
| 4,832,568 | A | * | 5/1989 | Roth et al. | 415/189 |
| 4,995,788 | A | * | 2/1991 | Turnberg | 416/230 |
| 5,074,752 | A | * | 12/1991 | Murphy et al. | 415/209.4 |
| 5,118,257 | A | * | 6/1992 | Blakeley et al. | 416/219 R |
| 5,160,243 | A | * | 11/1992 | Herzner et al. | 416/220 R |
| 5,240,375 | A | * | 8/1993 | Wayte | 416/219 R |
| 5,340,280 | A | * | 8/1994 | Schilling | 416/229 A |
| 5,443,366 | A | * | 8/1995 | Knott et al. | 416/221 |
| 5,573,377 | A | * | 11/1996 | Bond et al. | 416/229 A |
| 5,624,233 | A | * | 4/1997 | King et al. | 416/219 R |
| 5,791,877 | A | * | 8/1998 | Stenneler | 416/221 |
| 6,132,175 | A | * | 10/2000 | Cai et al. | 416/220 R |
| 6,398,499 | B1 | * | 6/2002 | Simonetti et al. | 416/193 A |
| 6,431,835 | B1 | * | 8/2002 | Kolodziej et al. | 416/219 R |
| 6,857,856 | B2 | * | 2/2005 | Potter et al. | 416/229 A |
| 8,282,356 | B2 | * | 10/2012 | Cairo | 416/219 R |
| 8,651,817 | B2 | * | 2/2014 | Radomski | 416/204 R |
| 2009/0016890 | A1 | * | 1/2009 | Douguet et al. | 416/219 R |
| 2009/0081046 | A1 | | 3/2009 | Mace et al. | |

FOREIGN PATENT DOCUMENTS

| | | |
|---|---|---|
| EP | 2 299 059 A2 | 3/2011 |
| FR | 1 319 689 | 3/1963 |
| GB | 836030 | 6/1960 |
| GB | 2 115 883 A1 | 9/1983 |

OTHER PUBLICATIONS

Search Report issued in British Application No. 1106050.6 dated Aug. 4, 2011.

* cited by examiner

RETENTION DEVICE FOR A COMPOSITE BLADE OF A GAS TURBINE ENGINE

The present invention relates to a retention device for a composite blade of a gas turbine engine. The invention is particularly concerned with axial retention of the composite blade within a fan disc of a gas turbine engine.

Fan assemblies in large gas turbine engines typically comprise a metal rotor disc provided with individual metallic fan blades. The rotor disc has axially extending dovetail slots disposed about the circumference of the disc into which the fan blades, which have corresponding dovetail roots, are inserted. The dovetail slots secure the fan blades in the radial and circumferential directions, but not in the axial direction. During operation, the fan blades are subject to axial loads generated, for example, by thrust and by foreign object damage on the blades. It is therefore necessary to secure the blade roots within the dovetail slots in an axial direction.

The mechanism selected for securing rotor blades against axial movement is generally dictated both by the size of the engine concerned and by past trends and experience. Thrust ring arrangements are commonly used in smaller engines, but for larger engines of 2 m diameter and above, shear keys are almost exclusively employed to provide the necessary axial retention. Use of a shear key involves forming cooperating slots in the flanks of both the blade root and the associated disc dovetail slot. A shear key is then inserted into the slots, connecting the two components. The sides of the shear key abut the sides of the slots in the blade root and disc, thus securing the blade against axial movement relative to the disc. This arrangement is known to be effective in securing conventional metallic blades within the rotor disc.

Organic matrix composite materials are now being explored as an alternative to metals for component parts of gas turbine engines. Composite materials can contribute to weight reduction with desirable strength to weight ratios, as well as offering resistance to most chemical and environmental threats. Component parts of the fan assembly, including in particular fan blades, lend themselves to composite construction owing to the relatively low temperatures at which they operate. Over these operating temperature ranges, composite materials can provide the required levels of robustness, durability, strength and strain to failure. However, difficulties are encountered when considering axial retention of composite fan blades within the dovetail slots of a rotor disc. The shear key arrangement described above is less suited to retention of composite blades, owing to the significantly lower load carrying capacity of the composite material when compared to the metals that are more conventionally employed. In order to achieve comparable load carrying capacity, the interface between the shear key and composite material of the blade must be oversized, resulting in a non optimised design. Additionally, the amount of material that must be removed from the blade root to create this oversized interface raises concerns over the mechanical integrity of the bade root, as well as having potential knock on effects on the geometrical definition of the blade/disc interface.

A further disadvantage of composite fan blades is that the interface between blade root and disc is a composite/metallic interface. This is outside the range of the extensive experience which has been gained with dry film lubricants for the metallic/metallic interfaces encountered with conventional titanium fan blades.

The present invention seeks to address some or all of the above noted disadvantages associated with composite fan blades.

In the present specification, the terms "axial", "radial" and "circumferential" are defined with respect to the axial direction of the rotor disc unless otherwise specified.

According to the present invention, there is provided a liner for a composite blade of a gas turbine engine, the liner comprising a metallic shoe for at least partially encasing a blade root of a composite blade, metallic shoe having an inner, an outer surface, and a retention lug, wherein the retention lug comprises an outer key which projects from an outer surface of the retention lug.

The retention lug can further comprise an inner key which projects from an inner surface of the retention lug.

The inner and outer keys can be located on opposing portions of the inner and outer surfaces.

The inner and outer keys may each have the same surface area as the retention lug. That is, there may or may not be a step change in thickness between the retention lug and the inner or outer keys.

The shoe may comprise a base portion and opposed flank portions, substantially corresponding to the base and flanks of a composite blade root. The retention lug may be formed on a flank portion of the shoe.

The retention lug may be metallic and may be integrally formed with the shoe or may be diffusion bonded to the shoe. Alternatively, the retention lug may be attached to the shoe by any other high integrity joining process.

The outer key of the retention lug may comprise a single projection which may have a constant thickness. The retention lug may thus present an outer profile having a single step change from the outer surface of the shoe to the projecting surface of the outer key.

The inner key of the retention lug may comprise a stepped projection having at least one change in thickness. The retention lug may thus present an inner profile having multiple step changes from the inner surface of the shoe to at least two distinct projecting surfaces of the inner key.

The liner may comprise two retention lugs and each lug may be formed on an opposed flank portion of the shoe.

According to another aspect of the present invention, there is provided a blade assembly for a gas turbine engine, the blade assembly comprising a composite blade and a liner according to the first aspect of the present invention.

The liner may be attached to the root of the blade by co-moulding.

The liner may be attached to the root of the blade by secondary bonding.

The inner key of the liner retention lug may engage a corresponding recess formed on the root of the blade.

For a better understanding of the present invention, and to show how it may be carried into effect, reference will now be made by way of example to the following drawings, in which:—

The present invention achieves axial retention of a composite blade root by better distributing the axial loads into the blade, thus addressing the issue of the lower crushing capability of the composite blade when compared with known titanium blades.

A liner comprising a metallic shoe and retention lugs is bonded onto the root of the blade to form the contact flanks of the blade root that will be received in a metallic dovetail slot.

The liner provides a metallic/metallic interface at the dovetail slot and distributes axial loading into the blade over a larger area than a conventional shear key. The rotor slot and blade root geometry, together with the reduced number of blades required in a composite design, ensure that the assembled blade and liner can be inserted, engaged, disengaged and extracted from the slot all without need for removal or retraction of the liner or its retention lugs.

Figure 1:
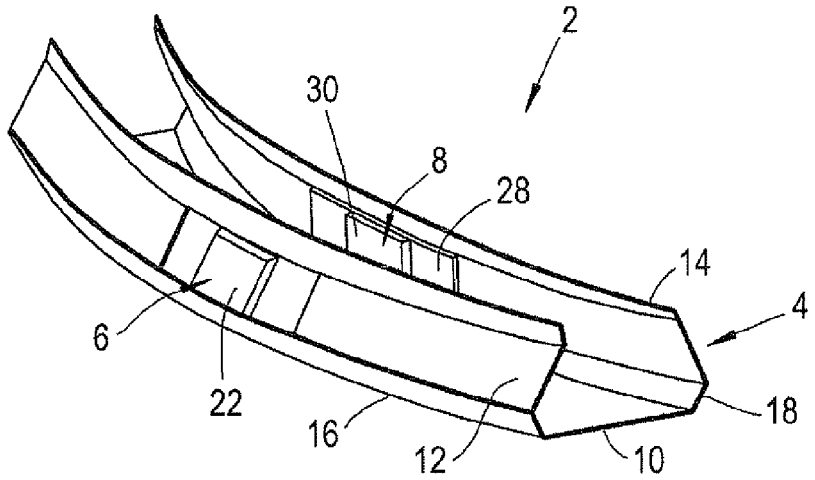
FIG. 1 is a perspective view of a liner for a composite blade.
Figure 2:
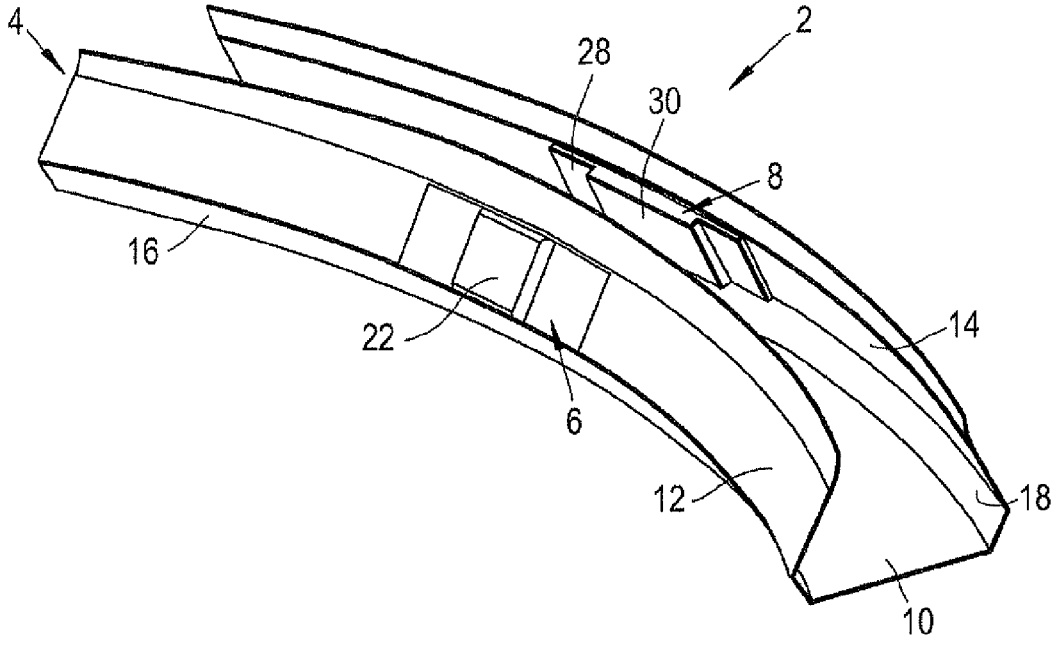
FIG. 2 is another perspective view of the liner of FIG. 1.

With reference to FIGS. 1 and 2, a liner 2 for a composite blade comprises a shoe 4 and first and second retention lugs 6, 8. The shoe 4 is formed from a metallic material and is shaped substantially to encompass the root portion of a composite blade of a gas turbine engine. The shoe 4 thus comprises a substantially C shaped cross section, with a base portion 10 and opposed angled flank portions 12, 14, each of which may be integrally formed with the base portion 10 via angled connecting regions 16, 18. The shoe 4 defines an inner surface 17, operable to engage the root of a composite blade, and an outer surface 19, operable to engage a dovetail slot in a rotor disc, as explained in further detail below. The shoe 4 may be co-moulded with the root portion of a respective blade, or may be attached by secondary bonding or any other appropriate joining process.

Figure 3:
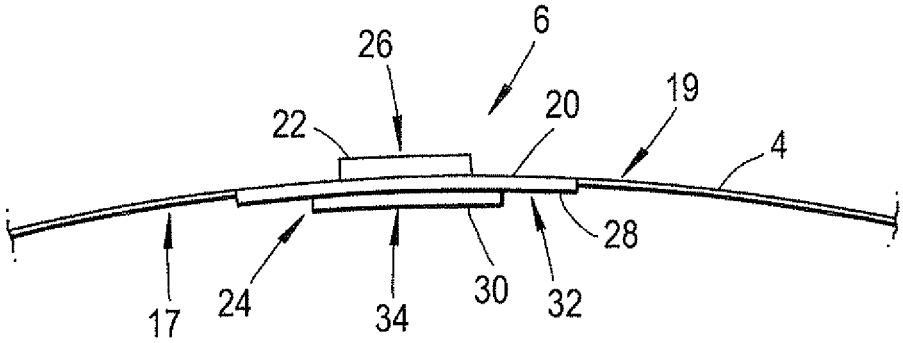
FIG. 3 is a longitudinal sectional view through a flank portion of the liner of FIG. 1.
Figure 4:
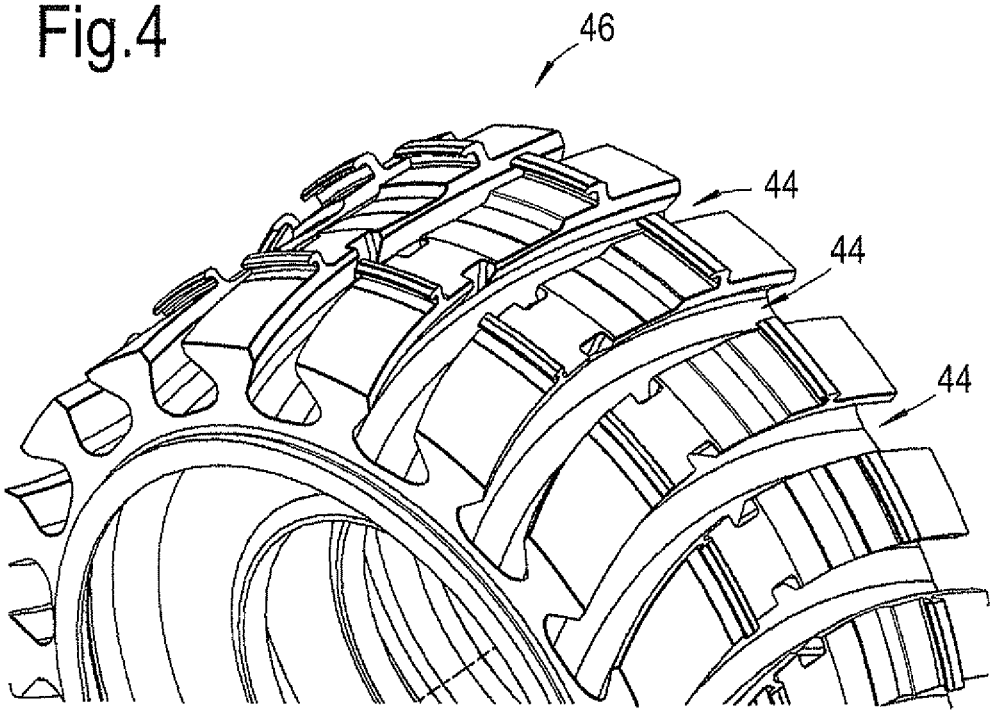
FIG. 4 is a partial perspective view of a rotor disc.

The retention lugs 6, 8 are formed on opposed regions of the flank portions 12, 14, one lug on each flank portion of the shoe 4. The first retention lug 6 is described in detail below with additional reference to FIG. 3. It will be appreciated that corresponding features may also be found on the second retention lug 8. The first retention lug 6 comprises a lug body 20, an outer key 22 projecting from an outer surface of the lug body 20, and a stepped inner key 24 projecting from the inner surface of the lug body 20. The retention lug 6 is attached to the flank portion 12 of the shoe 4 by diffusion bonding or any other high integrity joining process. The body of the retention lug 6 is flush to the outer surface 19 of the shoe 4. The outer key 22 projects substantially perpendicularly from the surface of the body 20 to a uniform thickness and presents a rectangular projecting surface 26. Viewed in section, as shown in FIG. 3, the lug 6 causes a step change in outer surface profile from the shoe/lug body surface 19 to the projecting surface 26.

The inner key 24 of the lug 6 comprises first and second stepped regions 28, 30, each presenting a substantially rectangular projecting surface 32, 34. The first region 28 projects substantially perpendicularly from the surface of the body 20 to a uniform thickness and presents a rectangular projecting surface 32 that is of substantially the same area as the body 20 of the lug 6. The second region 30 projects substantially perpendicularly from the projecting surface 32 of the first region 28 to a uniform thickness and presents a rectangular projecting surface 34. The uniform thicknesses of the outer key 22, the first region 28 and the second region 30 may be the same or different. The second projecting surface 34 is smaller in at least one dimension than the first projecting surface 32. In a preferred embodiment shown in the Figures, the projecting surfaces of the outer key 22 and both regions 28, 30 of the inner key 24 are all of the same width. The projecting surface 32 of the first region 28 of the inner key 24 is of the greatest length, equal to the length of the lug body 20. The projecting surface 34 of the second region 30 of the inner key 24 is of reduced length compared to the surface 32 of the first region 28, and the projecting surface 26 of the outer key 22 is of reduced length compared to the surface 34 of the second region 30. Viewed in section, as shown in FIG. 3, the lug 6 causes two step changes in inner surface profile from the inner shoe surface 17 to the first projecting surface 32 and from the first projecting surface 32 to the second projecting surface 34.

Figure 5:
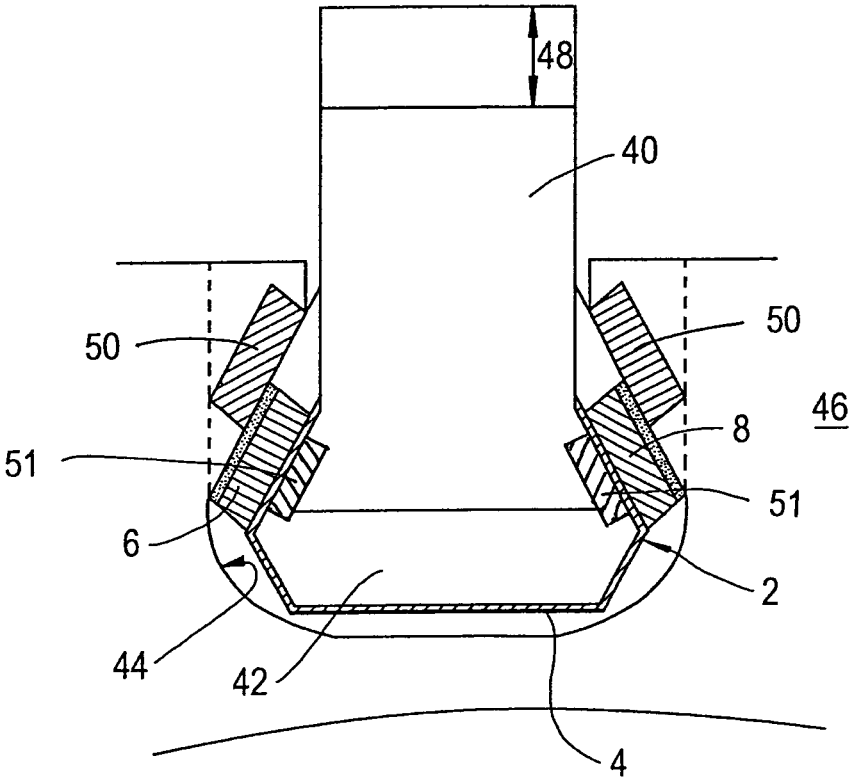
FIG. 5 is a sectional view of a blade assembly in a dovetail slot of a rotor disc.

In use, as illustrated in FIG. 5, the liner 2 comprising the shoe 4 and lugs 6, 8 is co-moulded or secondary bonded to the root portion 42 of a blade 40. The assembly of blade 40 and liner 2 is then inserted into a dovetail slot 44 of a rotor disc 46. The obtuse flank angle of the assembly and corresponding slot, together with the comparatively low blade count for composite blade arrangements, ensures that the blade assembly may be inserted into the disc slot 44 and chocked into position in a conventional manner, without the need for retraction or removal of the retention lugs 6, 8.

The assembly is inserted into the slot 44 in a radially inner position, shown in strong outline in FIG. 5. The assembly is inserted until the outer keys 22 of the retention lugs 6, 8 are level with corresponding recesses 50 formed in the flank walls of the slot 44. The assembly of blade root 42 and liner 2 is then displaced radially outwardly by insertion of a chocking member between the base portion 10 of the shoe 4 and the bottom of the dovetail slot 44. The displacement is illustrated at arrow 48 and may for example be approximately 15 mm. The assembly is displaced until the flank portions of the shoe 4 engage with the flanks of the dovetail slot 44. At the same time, the outer keys 22 of the lugs 6, 8 engage with the corresponding recesses 50 designed to receive them. The inner key 24 of the liner retention lugs 6, 8 may engage a corresponding recess 51 formed on the blade root 42.

The shoe 4 of the liner 2 is thus sandwiched between the root 42 of the blade 40 and the flanks of the dovetail slot 44. The compressive load placed on the flank portions 12, 14 of the shoe 4 resists any tendency of the shoe 4 to detach from the blade root 42 by shear and negates the bond peel failure mode of the bonding between the shoe 4 and blade root 42.

The sides of the outer keys 22 of the lugs 6, 8 abut the sides of the recesses 50 formed in the dovetail slot 44 and prevent axial displacement of the assembly of blade root 42 and liner 2 within the dovetail slot. Axial loads are reacted into the blade 40 via the metallic shoe 4 and then via shear in the bond to the body of the blade 40. Load distribution into the root 42 is achieved via the stepped inner keys 24. The stepped inner keys 24 distribute the load more evenly across the blade root than a standard shear key, and over a larger area, thus addressing the issue of the lower crushing capability of a composite blade. Potential wedging effects are avoided by having step changes in thickness of the inner keys rather than a tapered change. The step changes also assist with preventing rotation of the lugs and any corresponding stresses.

In addition to distributing axial loads over a wider area within a composite blade, and thus enabling a composite blade to be adequately restrained against axial movement without compromising mechanical integrity, the liner of the present invention provides a metallic/metallic interface between the assembled blade 40 and liner 2 and the dovetail slot 44 in the rotor disc. Known dry film lubricants for use with conventional metallic blades can therefore be employed at the assembly/slot interface.

The invention claimed is:

1. A liner for a composite blade of a gas turbine engine, the liner comprising a metallic shoe for at least partially encasing a blade root of a composite blade, the metallic shoe having an inner surface, an outer surface, and a retention lug, wherein the retention lug comprises an outer key which projects from an outer surface of the retention lug and configured for axial retention of the blade, wherein the metallic shoe comprises a base portion and opposed flank portions, and wherein the retention lug is formed on a flank portion.

2. The liner as claimed in claim 1, wherein the retention lug further comprises an inner key which projects from an inner surface of the retention lug.

3. The liner as claimed in claim 2, wherein the inner and outer keys are located on opposing portions of the inner and outer surfaces.

4. The liner as claimed in claim 2, wherein the inner key of the retention lug comprises a stepped projection having at least one change in thickness.

5. The liner as claimed in claim 1, wherein the liner comprises two retention lugs, each lug formed on an opposed flank portion of the shoe.

6. The liner as claimed in claim 1, wherein the retention lug is metallic.

7. The liner as claimed in claim 1, wherein the retention lug is integrally formed with the shoe.

8. The liner as claimed in claim 1, wherein the retention lug is diffusion bonded to the shoe.

9. The liner as claimed in claim 1, wherein the outer key of the retention lug comprises a single projection having a constant thickness.

10. A blade assembly for a gas turbine engine, comprising a composite blade and the liner as claimed in claim 1.

11. The blade assembly as claimed in claim 10, wherein the liner is attached to the blade root of the composite blade by co-moulding.

12. The blade assembly as claimed in claim 10, wherein the liner is attached to the blade root of the composite blade by secondary bonding.

13. The blade assembly as claimed in claim 10, wherein the retention lug further comprises an inner key which projects from an inner surface of the retention lug, and wherein the inner key of the liner retention lug engages a corresponding recess formed on the blade root of the composite blade.

* * * * *